US007815517B1

(12) United States Patent
Sardo et al.

(10) Patent No.: US 7,815,517 B1
(45) Date of Patent: Oct. 19, 2010

(54) MIRRORED FEEDBACK SYSTEM FOR REVEALING HEAD MOVEMENT DURING GOLFER'S BACKSWING

(76) Inventors: Lou Sardo, 1629 Verdugo Blvd., La Canada, CA (US) 91011; Brendan Riley, 778 Idlehour La., Sierra Madre, CA (US) 91024; John Hunter, 1335 Tamo Shanter, Azusa, CA (US) 91702

( * ) Notice: Subject to any disclaimer, the term of this patent is extended or adjusted under 35 U.S.C. 154(b) by 0 days.

(21) Appl. No.: 12/456,757

(22) Filed: Jun. 22, 2009

(51) Int. Cl.
*A63B 69/36* (2006.01)

(52) U.S. Cl. ..... 473/267; 473/268; 473/409

(58) Field of Classification Search ..... 473/219, 473/266, 267, 268, 269, 422, 435, 409
See application file for complete search history.

(56) References Cited

U.S. PATENT DOCUMENTS

| | | | | | |
|---|---|---|---|---|---|
| 3,000,261 | A | | 9/1961 | Frenkel | 88/74 |
| 3,110,495 | A | * | 11/1963 | Carter | 473/267 |
| 3,917,278 | A | * | 11/1975 | Steinman, Jr. | 473/267 |
| 4,383,687 | A | * | 5/1983 | Wolff | 473/267 |
| 4,483,536 | A | | 11/1984 | Mitchell | 273/183 |
| 5,174,576 | A | | 12/1992 | Lee et al. | 273/187 |
| 5,486,003 | A | * | 1/1996 | Loew et al. | 473/267 |
| 6,612,937 | B1 | | 9/2003 | Whelan | 473/268 |
| 6,746,339 | B1 | | 6/2004 | Thibaudeau | 473/268 |
| 7,458,901 | B2 | | 12/2008 | Hoganson | 473/268 |
| 2007/0243944 | A1 | | 10/2007 | Paukune et al. | 473/267 |

* cited by examiner

*Primary Examiner*—Nini Legesse
(74) *Attorney, Agent, or Firm*—Goldstein Law Offices, P.C

(57) ABSTRACT

A feedback device, for use by a golfer to indicate head movement during a backswing. The device has a base, a forward plate having a transparent portion with a printed horizontal line thereupon, and a parallel mirrored surface located behind the forward plate. A reflected horizontal line is selectively viewed through the transparent portion. When the device is viewed at a first viewing angle, only a single line is visible, such that the reflected horizontal line is blocked from the golfer's view by the printed horizontal line. When the device is viewed at a second viewing angle, both lines are visible. Accordingly vertical head movement during the backswing is immediately apparent to the golfer when both lines become visible during the backswing.

8 Claims, 6 Drawing Sheets

MIRRORED FEEDBACK SYSTEM FOR REVEALING HEAD MOVEMENT DURING GOLFER'S BACKSWING

BACKGROUND OF THE INVENTION

The invention relates to a mirrored feedback system. More particularly, the invention relates to system that employs a mirrored device, placed within the golfer's visual path immediately in front of the golfer on an opposite side from the ball position, to provide feedback to the golfer about undesirable head movements during the golfer's back or practice swing.

Cultivating a proper golf swing is one of the most difficult and time consuming activities, comparable to the most complex of all sporting skills. Beyond the mechanics of the proper swing itself, a key element is controlling and preventing extraneous body movements. Such movements can "throw off" the swing, and be the difference between achieving phenomenal results, and achieving mediocre to poor results.

Among the movements that a good golfer has under control, is head movements during the swing. In particular, with regard to the backswing, the head should not move. In this regard, while a little side to side movement may be acceptable, vertical or up and down movement during the backswing can have disastrous consequences on the ensuing forward swing.

In golf, it is common to take a practice swing before actually hitting the ball. In particular, the golfer steps back from the ball, and takes a full swing. Without proper feedback regarding the practice swing, however, the golfer might very well be simply reinforcing bad habits during the practice swing. Accordingly, the golfer might then confidently step forward and hit the ball with all of those bad habits—including extraneous movements—fully in place.

To date, a myriad of training techniques and devices have been proposed that seek to train the golfer to eliminate extraneous head movements. None of these systems, methods, or devices offer the immediate visual feedback provided by the present invention.

Accordingly, while these units may be suitable for the particular purpose employed, or for general use, they would not be as suitable for the purposes of the present invention as disclosed hereafter.

SUMMARY OF THE INVENTION

It is an object of the invention to produce a device which aids a golfer in learning to make a proper backswing such that his head does not move during the backswing. Accordingly, the device provides immediate visual feedback to either confirm that the golfer's head has not moved during the backswing, or to reveal any undesired head movement during the backswing.

It is another object of the invention to produce a device which immediately reveals an undesirable head movement. Accordingly, the device has a transparent forward plate with a printed horizontal line thereupon, and has a parallel mirror behind the forward plate. When viewed at the proper angle, only a single line will be viewed, such that the reflection of the line is blocked by the printed line itself. If the head subsequently moves, and alters said angle, both the printed line and the reflected line will be visible—indicating that viewing angle has changed, and thus the head has moved.

It is a further object of the invention to provide a device that may be used on the golf course, during play. Accordingly, the device is compact, and may be simply placed on the ground, generally 5 to 10 feet in front of the golfer, such that the proper angle can be readily achieved by the golfer when addressing the ball, and when positioned slightly behind the ball as for a practice swing—according to the desired use. Once properly positioned, the golfer may back up from the ball to take a practice swing, and observe any undesired head movements that occur during the backswing of the practice swing.

It is yet a further object of the invention to provide a device that is inexpensive to manufacture. Accordingly the device may be fabricated using a few plastic panels and a mirror, and may be assembled in a few simple steps.

The invention is a feedback device, for use by a golfer to indicate head movement during a backswing. The device has a base, a forward plate having a transparent portion with a printed horizontal line thereupon, and a parallel mirrored surface located behind the forward plate. A reflected horizontal line is selectively viewed through the transparent portion. When the device is viewed at a first viewing angle, only a single line is visible, such that the reflected horizontal line is blocked from the golfer's view by the printed horizontal line. When the device is viewed at a second viewing angle, both lines are visible. Accordingly vertical head movement during the backswing is immediately apparent to the golfer when both lines become visible during the backswing.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
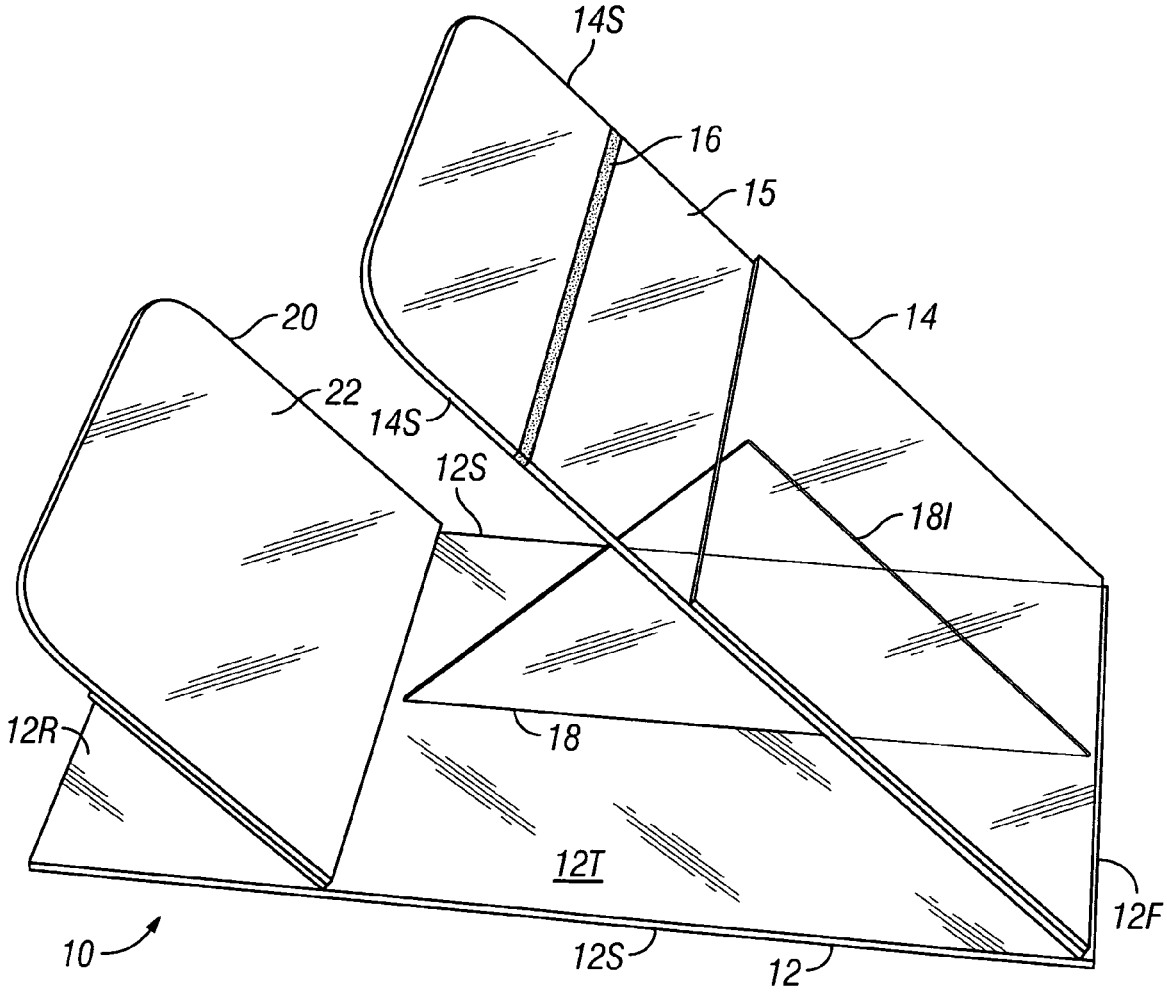
FIG. 1 is a diagrammatic perspective view, illustrating the present invention, per se.

FIG. 1 illustrates a mirrored feedback device 10 including a horizontal base 12, having a top surface 12T, a front edge 12F, a rear edge 12R, and a pair of side edges 12S. The device includes a forward plate 14 which extends upwardly from the base 12, preferably originating at the front edge 12F and angled rearwardly generally toward the rear edge 12R at an acute, predetermined angle.

The forward plate 14 has a pair of side edges 14S, includes a transparent portion 15, and has a printed horizontal line 16 extending substantially between said side edges 14S, and substantially parallel to the base 12. The printed horizontal line 16 is dark and sufficiently well defined that it is easily visible form a distance of approximately 5 to 10 feet. The forward plate 14 may be supported by an angled support plate 18 which is secured to the base 12, and extends longitudinally thereupon from the front edge 12F toward the rear edge 12R, substantially between the side edges 12S of the base 12. The forward plate 14 has a leading edge 181 which extends at the predetermined angle from the base 12.

A parallel mirror plate 20 extends behind the forward plate 14, extending substantially parallel to the forward plate, such that the printed line 16 is substantially centered upon the parallel mirror plate 20. The parallel mirror plate 20 has a mirrored front surface 22 capable of reflecting the printed line 16 such that it is clearly visible from a distance of 5-10 feet.

Figure 3:
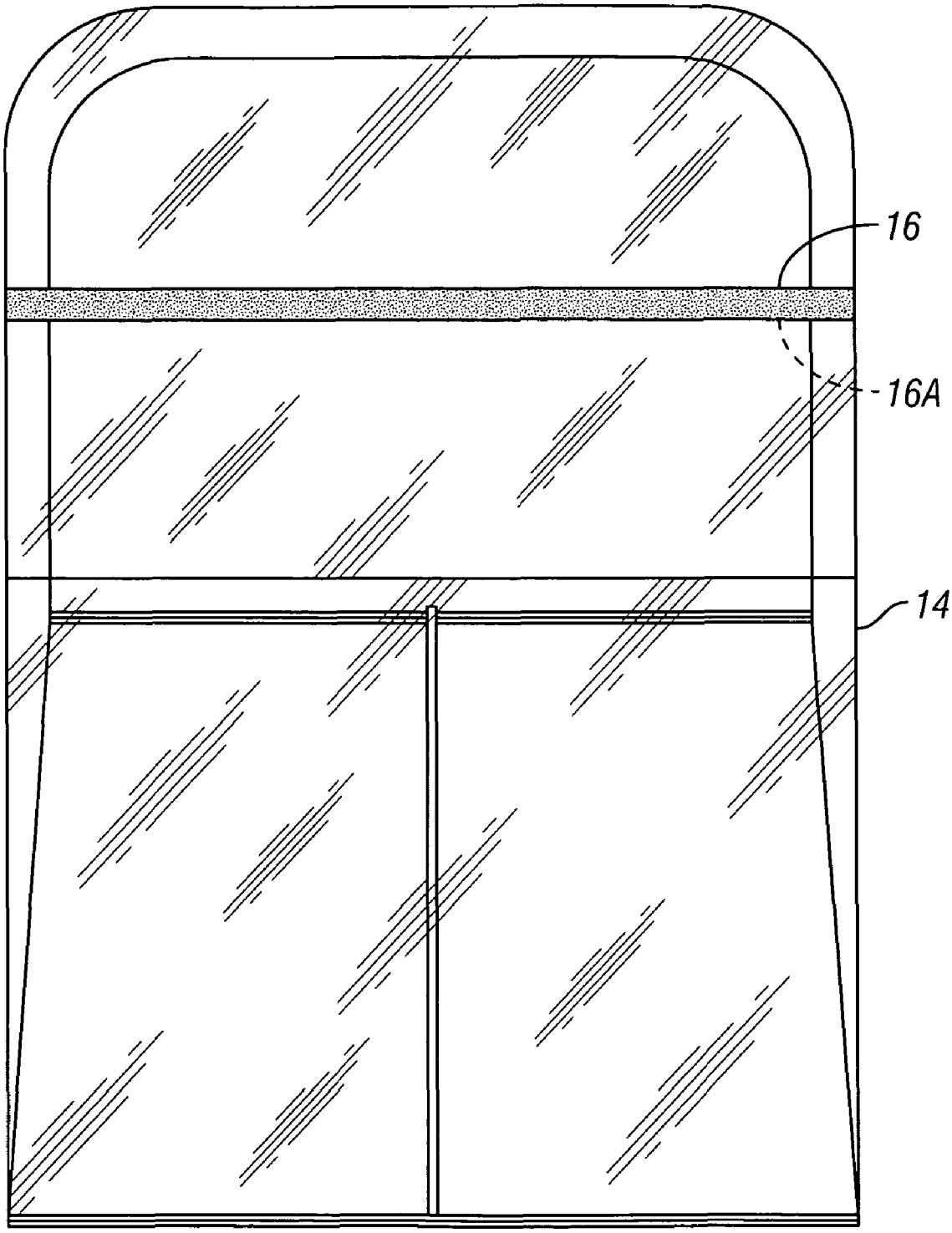
FIG. 3 is a plan view, taken along the golfer's pre-swing visual path as indicated by arrow 3 in FIG. 2.
Figure 6:
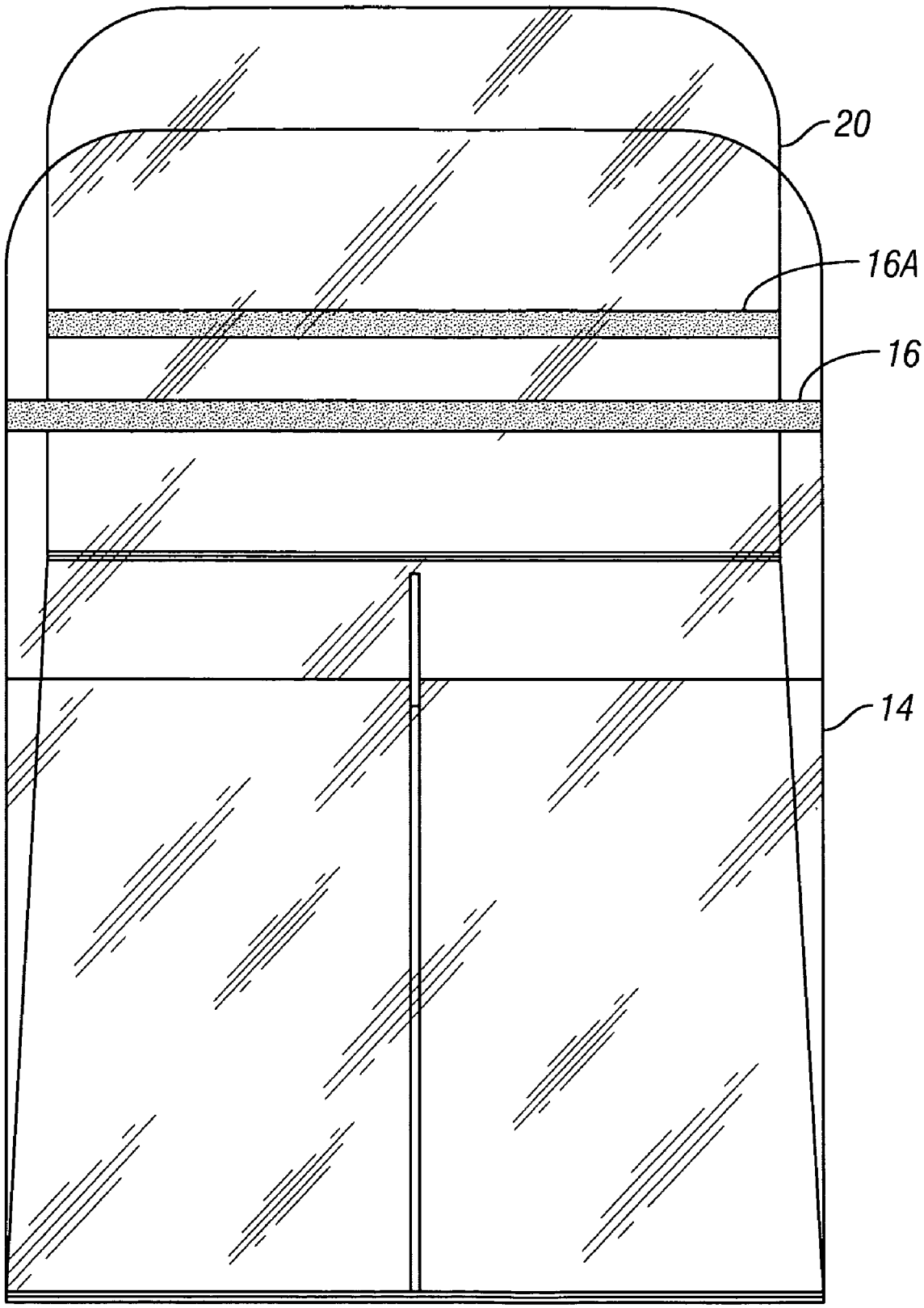
FIG. 6 is a top plan view, taken in the direction of arrow 6 in FIG. 5, wherein the golfer views a double line in the device due to (and revealing to him) the undesirable head movement in FIG. 5 during his backswing.

Referring briefly to FIGS. 3 and 6, a reflected horizontal line 16A may be seen in the mirrored front surface 22 of the parallel mirror plate 20 by a viewer, by looking through the transparent portion 15 of the forward plate 14. Whether the reflected horizontal line 16A will actually be seen, however, is dependent of a viewing angle of the viewer. In particular, at a precise viewing angle, such as perpendicular to the forward plate 14 and viewing angle and centered thereupon, the reflected horizontal line 16A will not be seen, since it will be directly behind, and thus blocked by the printed horizontal line 16 (as seen in FIG. 3). When the viewing angle is such that the reflected horizontal line 16A is not blocked by the printed horizontal line 16, two lines will be visible to the viewer simultaneously: the printed horizontal line 16 and the reflected horizontal line 16A—as seen in FIG. 6. It is the clear difference between what is viewed when the viewing angle is changed that is exploited by the present invention to aid in training a golfer to prevent extraneous head movements during a backswing, as will be described in detail hereinafter.

Figure 2:
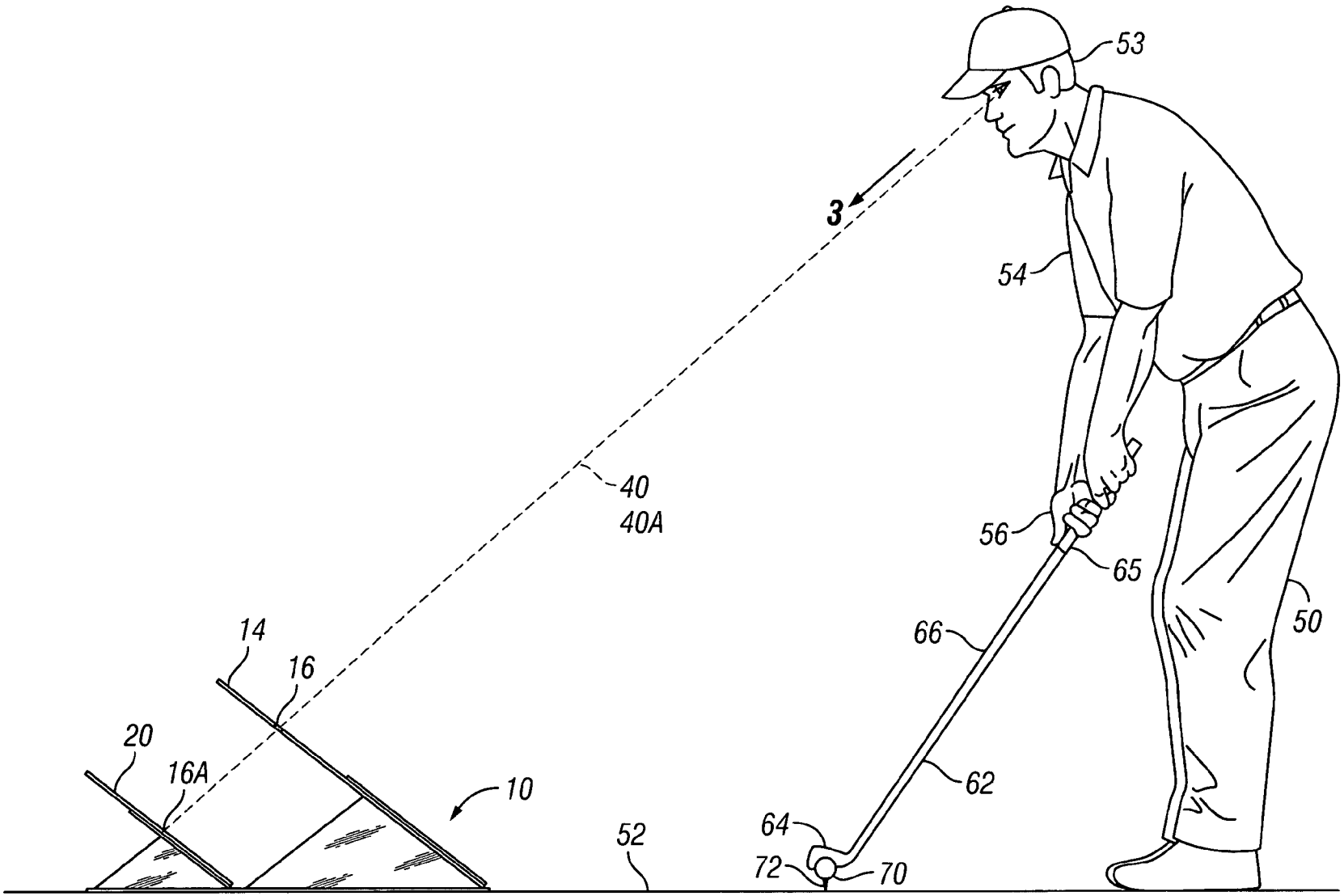
FIG. 2 is a front elevational view, illustrating the golfer addressing a golf ball, and looking at the present invention, viewing a single line, with his visual path such that the reflection of said line in the mirror is blocked by the line itself.

FIG. 2 illustrates a golfer 50, standing on a ground surface 52. Note that the golfer 50 illustrated in FIG. 2 and the remaining figures is a man, and thus "he", "him", and "himself" is used for the purposes of consistency only. The golfer has a head 53, and arms 54 having hands 56. A golf club 62 has a head 64, a handgrip 65, and a shaft 66. The golfer 50 is grasping the handgrip 65 with his hands 56. A golf ball 70 is suspended just above the ground surface 52 with a golf tee 72. The golfer 50 is standing upon the ground surface 52 behind the golf ball 70. The golfer is shown addressing the golf ball 70, wherein the club head 64 is statically engaged with the golf ball 70. The golfer is properly in the position illustrated, just before taking a backswing.

In accordance with the principles of the present invention, mirrored feedback device 10 is positioned with its base 12 resting upon and substantially parallel to the ground surface 52. The device is positioned in front of the golfer 50 and in front of the golf ball 70, such that the golf ball is positioned directly between the golfer 50 and the device 10.

As illustrated in FIG. 2, the golfer 50 is gazing at the device 10 at a viewing angle 40. In particular, the viewing angle 40 here is a first viewing angle 40A, wherein the golfer observes the printed horizontal line 16 on the forward plate 14, but does not see the reflected horizontal line 16A on the parallel mirror plate 20, since it is blocked from view along the first viewing angle 40A by the printed horizontal line 16. What the golfer 50 sees in the first viewing angle 40A is illustrated in FIG. 3. Accordingly, the golfer 50 initially positions himself and the device 10 such that he will gaze at the device at the first viewing angle 40A when he is about to initiate a backswing. Thus, since the present invention would often be used during a practice swing—during which time the golfer steps back approximately two feet behind the ball—the device 10 is advantageously positioned so that the first viewing angle 40A can be easily achieved while the golfer is in position to take a practice swing.

Figure 4:
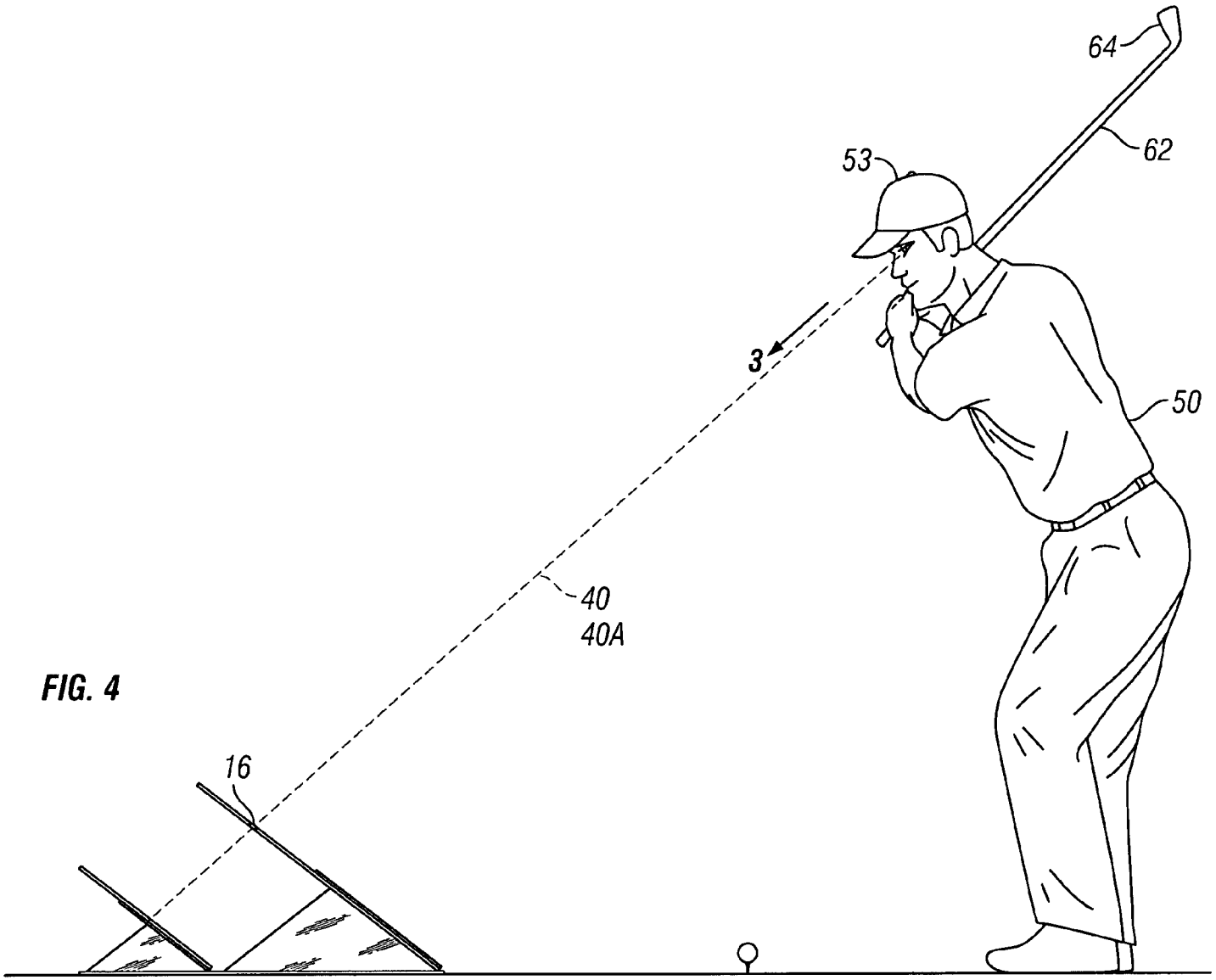
FIG. 4 is a front elevational view, wherein the golfer has taken a proper backswing, wherein his head has not moved, and thereby views a single line within his visual path, as he did in FIG. 2, and as indicated by arrow 3 in FIG. 2.

In FIG. 4, the golfer 50 is illustrated at the peak of the backswing, wherein the club 62 extends upwardly above the golfer 50, with the club head 64 at its apex. If the backswing has been properly taken, the golfer's head 53 remains in the same position as prior to the backswing (as shown in FIG. 3). Accordingly, the viewing angle 40 is still the first viewing angle 40A as in FIG. 3. Thus, the golfer 50 in FIG. 3 still only sees a single line when gazing at the device 10—the printed horizontal line 16—which provides immediate feedback to the golfer 50 that he was successful in keeping his head still during the backswing.

Figure 5:
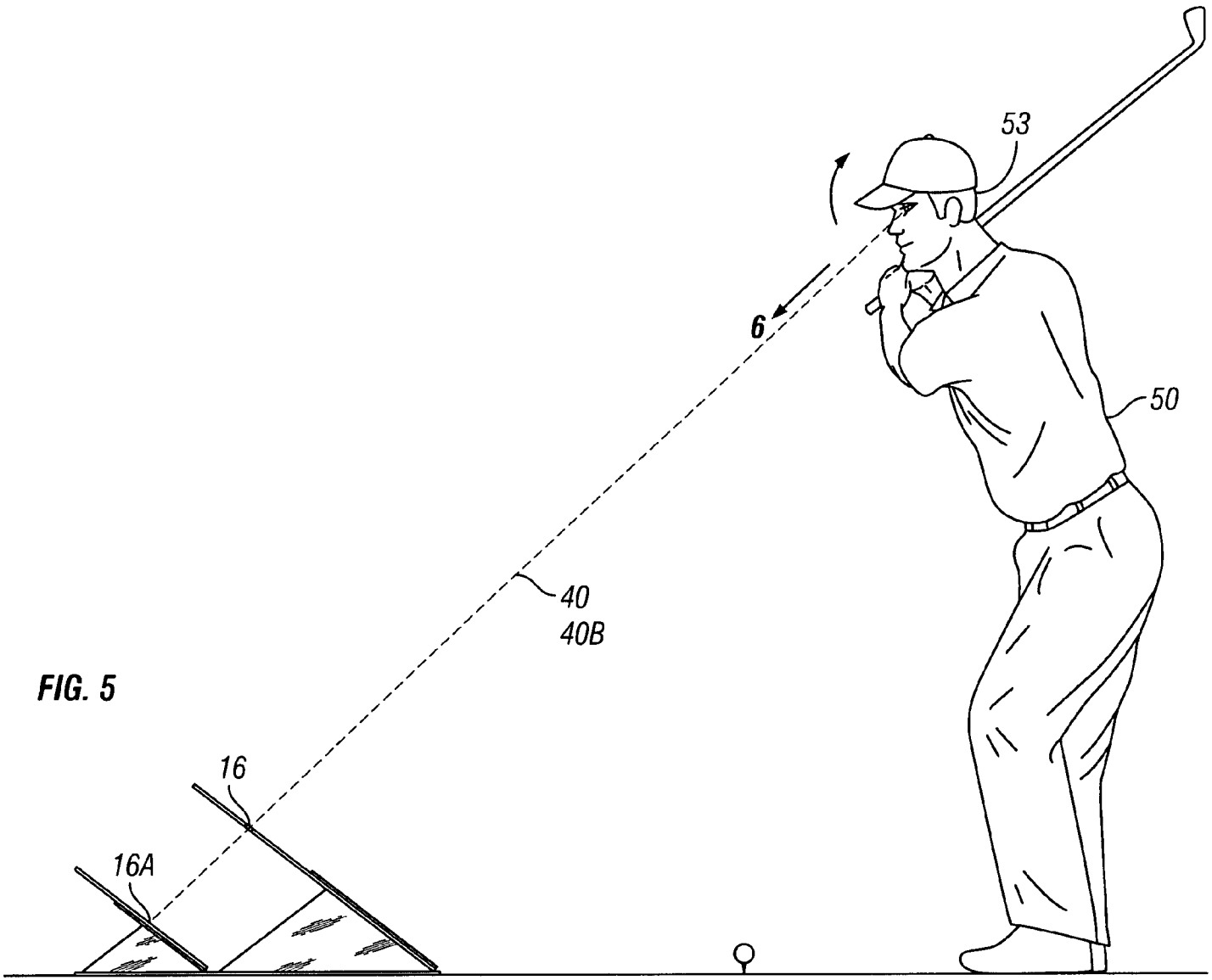
FIG. 5 is a front elevational view, similar to FIG. 5, except wherein the golfer has made an undesirable head movement, thereby altering his visual path and his view of the line.

FIG. 5 also illustrates the golfer 50 at the peak of the backswing. In FIG. 5, however, the golfer 50 has moved his head 53 during the backswing, as indicated. Accordingly, the golfer 50 is now gazing at the device 10 at a second viewing angle 40B as seen in FIG. 6. Thus, the golfer sees two lines—both the printed horizontal line 16 and the reflected horizontal line 16A. Seeing two lines gives the golfer 50 immediate feedback that he moved his head 53 during the backswing.

In use, the mirrored feedback device 10 generally be set up in front of both the golfer 50 and the golf ball 70. The mirrored feedback device 10 would generally be positioned to afford view at the first viewing angle, when the golfer is positioned for a practice swing. When the golfer 50 steps back from the ball to take a practice swing, the golfer initially gazes at the device 10 and keeps his eyes fixed on the device as he initiates a backswing, as he slowly draws the club rearwardly and upwardly, and until he brings the club to the peak of the backswing. If his head moves at all vertically during the backswing, not only will be notice that the printed horizontal line has moved within his field of view, but he will immediately notice the departure from the first viewing angle 40A by the appearance of a second line within his view. By immediately noticing any extraneous head movements, the golfer can effectively train himself to keep his head still during the backswing.

In conclusion, herein is presented a system for providing immediately feedback to a golfer about extraneous head movement during the backswing, by showing the golfer two horizontal lines rather than a single line when his head moves during the backswing. The invention is illustrated by example in the drawing figures, and throughout the written description. It should be understood that numerous variations are possible, while adhering to the inventive concept. Such variations are contemplated as being a part of the present invention.

What is claimed is:

1. A feedback device, for use by a golfer having a head and a pair of hands, while standing upon a ground surface and taking a golf backswing with a golf club having a head, a shaft, and a handgrip, comprising:

a base having a front edge, for resting upon the ground surface in front of the golfer, such that the golfer has a view of said device;

a forward plate, extending at an acute predetermined angle to the base plate, extending rearwardly and upwardly from near the front edge, the forward plate having a transparent portion and having a horizontal printed line thereon; and a parallel mirror plate, extending behind the forward plate and substantially parallel thereto, the parallel mirror plate having a mirrored front surface for reflecting the horizontal printed line as a reflected horizontal line, the printed horizontal line selectively blocking the reflected horizontal line with the printed horizontal line when viewed by the golfer at a first viewing angle, the transparent portion selectively allowing the reflected horizontal line to be viewed through the transparent portion of the forward plate when viewed by the golfer at a second viewing angle, the feedback device thereby revealing to the golfer vertical head movements when the golfer's view changes from the first viewing angle to the second viewing angle.

2. The feedback device as recited in claim 1, wherein the forward plate has a pair of side edges, and wherein the printed horizontal line extends fully between the side edges, and substantially parallel to the base.

3. The feedback device as recited in claim 2, wherein the base has side edges, and further comprising an angled support plate having a leading edge extending at the predetermined acute angle, the angled support plate extending rearwardly upon the base immediately behind the forward plate and secured to the forward plate, for supporting the forward plate.

4. A feedback device, for use by a golfer having a head and a pair of hands, while standing upon a ground surface and taking a golf backswing with a golf club having a head, a shaft, and a handgrip, comprising:

a base having a front edge, for resting upon the ground surface in front of the golfer, such that the golfer has a view of said device;

a forward plate, extending at an acute predetermined angle to the base plate, the forward plate having a transparent portion and having a horizontal printed line thereon; and a parallel mirror plate, extending behind the forward plate and substantially parallel thereto, the parallel mirror plate having a mirrored front surface for reflecting the horizontal printed line as a reflected horizontal line, the printed horizontal line selectively blocking the reflected horizontal line with the printed horizontal line when viewed by the golfer at a first viewing angle, the transparent portion selectively allowing the reflected horizontal line to be viewed through the transparent portion of the forward plate when viewed by the golfer at a second viewing angle, the feedback device thereby revealing to the golfer vertical head movements when the golfer's view changes from the first viewing angle to the second viewing angle.

5. The feedback device as recited in claim 4, wherein forward plate is secured to and extends upwardly and rearwardly from the base; and wherein the parallel mirror plate is secured to and extends upwardly and rearwardly from the base.

6. The feedback device as recited in claim 5, wherein the base has side edges, and further comprising an angled support plate having a leading edge extending at the predetermined acute angle, the angled support plate extending rearwardly upon the base immediately behind the forward plate and secured to the forward plate, for supporting the forward plate.

7. The feedback device as recited in claim 6, wherein the forward plate has a pair of side edges, and wherein the printed horizontal line extends fully between the side edges, and substantially parallel to the base.

8. A feedback method, for use by a golfer having a head and a pair of hands, while standing upon a ground surface and taking a golf backswing with a golf club having a head, a shaft, and a handgrip, using a device having a base, a forward plate extending rearwardly from the base at an acute angle and having a transparent portion having a printed horizontal line thereupon, a parallel mirror plate located behind the forward plate for providing a reflection of the printed horizontal line known as a reflected horizontal line, comprising the steps of:

placing the device upon the ground surface in front of the golfer;

blocking the reflected horizontal line from view by the golfer by the printed horizontal line by viewing the device at a first viewing angle;

taking a backswing by the golfer to a peak of the backswing while viewing the device by the golfer; and observing the device and determining if the golfer's head has moved by one of:

noticing the device at the first viewing angle, indicating to the golfer no head movement during the backswing, and noticing the device at a second viewing angle wherein the reflected horizontal line is seen through the transparent portion indicating to the golfer that there was head movement during the backswing.

* * * * *